US006301875B1

(12) United States Patent
Backlund et al.

(10) Patent No.: US 6,301,875 B1
(45) Date of Patent: Oct. 16, 2001

(54) TURBINE EXHAUST GAS DUCT HEATER

(75) Inventors: Jonathan C. Backlund, Menlo Park; Enrico E. Fiorenza, Half Moon Bay; Kenneth Y. Ahn, South San Francisco, all of CA (US)

(73) Assignee: Coen Company, Inc., Burlingame, CA (US)

( * ) Notice: Subject to any disclaimer, the term of this patent is extended or adjusted under 35 U.S.C. 154(b) by 0 days.

(21) Appl. No.: 09/584,245

(22) Filed: May 31, 2000

(51) Int. Cl.[7] ..... F02C 7/08

(52) U.S. Cl. ..... 60/39.5; 431/5; 431/9; 431/202

(58) Field of Search ..... 431/5, 9, 46, 181, 431/187, 202; 60/39.5, 749

(56) References Cited

U.S. PATENT DOCUMENTS

| | | | | |
|---|---|---|---|---|
| 4,462,795 | | 7/1984 | Vosper et al. . | |
| 4,767,319 | | 8/1988 | Vosper . | |
| 5,142,858 | * | 9/1992 | Ciokajlo et al. | 60/39.33 |
| 5,267,851 | * | 12/1993 | Washam et al. | 431/9 |
| 5,341,645 | * | 8/1994 | Ansart et al. | 60/737 |
| 5,367,874 | * | 11/1994 | Auffert et al. | 60/261 |

* cited by examiner

*Primary Examiner*—Charles G. Freay
(74) *Attorney, Agent, or Firm*—Townsend and Townsend and Crew

(57) ABSTRACT

A heater for heating turbine exhaust gas (TEG) flowing in a downstream direction through a duct formed by sets of opposing side walls is described. A flame shield has first and second plates which extend symmetrically with respect to a horizontal center line substantially across the duct, diverge in the downstream direction, and terminate in plate edges which are spaced from proximate duct side walls. Each plate defines spaced-apart, first and second slits which communicate an upstream side of the plate with a downstream side thereof. The slits are spaced from the center line and from the plate edges. A heating gas supply pipe extends parallel to the center line across the duct and has a plurality of spaced-apart orifices that face in a downstream direction and are in flow communication with the downstream side of the plate. All orifices are arranged to discharge heating gas jets parallel to the downstream direction, and a baffle extends from respective proximate duct walls towards the center line and terminates in baffle edges which are parallel to, spaced from and in substantial alignment with the plate edges. Heating gas injected into a space of the duct downstream of the flame shield ignites and forms first and second recirculation zones which are spaced from each other in the downstream direction to thereby prolong a residence time of heating gas in the combustion zone sufficiently to substantially completely convert all CO into $CO_2$ before the $CO_2$ leaves the combustion zone.

13 Claims, 3 Drawing Sheets

TURBINE EXHAUST GAS DUCT HEATER

BACKGROUND OF THE INVENTION

The present invention relates to heaters for raising the temperature of a gas flow, and in particular heaters for efficiently heating turbine exhaust gases in a non-polluting manner.

It is well known to use gas burners for raising the temperature of turbine exhaust gas (TEG) sufficiently (typically by between 100°–600° F.) so that the TEG can be used to generate steam, for example. Generating steam with TEG is efficient because the energy that would otherwise be needed for reaching the temperature of the incoming TEG is saved.

In the past, a variety of TEG heaters have been proposed, such as those disclosed in U.S. Pat. Nos. 4,767,319 and 4,462,795, for example.

A recurring problem with known TEG heaters is that they release pollutants, particularly CO. Significant amounts of CO are a byproduct of known TEG heaters because there is insufficient time to convert initially formed CO from combusting the heating gas into $CO_2$ during the former's residence time in the flame or combustion zone of the heater. As part of the overall effort to protect the environment, regulations have therefore been promulgated in the U.S. which now limit the release of CO from TEG heaters to 0.1 lb/million btu generated by the heater. This is a stringent requirement in and of itself. It has become more difficult to attain with increased turbine efficiencies, which resulted in a decrease in $O_2$ concentration (by volume) in the TEG. To alleviate this, it has been proposed to augment the TEG heater with additional air. Although this helps to reduce CO emissions, since more $O_2$ is made available to effect a complete combustion of the heating gas, it lowers the efficiency of the heater because the augmenting air must be heated from ambient to the temperature of the incoming TEG.

Achieving complete combustion of the CO generated by the TEG heater becomes still more difficult when steam is injected into the turbine, which in turn reduces the $O_2$ concentration in the TEG.

It has previously been recognized that CO emissions are reduced by increasing the residence time for the CO in the combustion zone of the TEG heater because this enhances the likelihood that CO will find an available $O_2$ molecule and be converted to $CO_2$. Thus, for several years a TEG heater has been in use which consisted of a flame shield that extended across the TEG duct, had a gas supply pipe positioned on a center line of the duct, and had a flame shield defined by plates which diverged (in the downstream direction) from the gas pipe towards the walls of the duct. Spaced-apart slits were arranged in the plate through which TEG could flow into the combustion zone located downstream of the flame shield. Diverging heating gas jets were injected into the combustion zone to generate turbulence and effect a better mixing of heating gas with the TEG. Although this TEG heater worked well, it is unable to meet today's tightened CO emissions standards.

Other known TEG heaters have attempted a variety of different approaches to reduce CO emissions. These attempts principally concentrated on efforts to discharge the heating gas into the TEG flow to maximize turbulence and thereby a mixing of the TEG with the heating gas and/or augmenting the TEG with air to provide greater $O_2$ concentrations for oxidizing the heating gas. Still, the desired reduction in CO emissions to no more than 0.1 lb/$10^6$ btu in an energy efficient manner became difficult to attain.

SUMMARY OF THE INVENTION

In TEG heaters, the oxygen for burning the heating gas is obtained from the TEG. As turbines became more efficient, and more water was injected into them, the relative concentration of $O_2$ decreased, resulting in a corresponding increase in CO emissions due to its incomplete oxidation in the combustion zone of the heater. One way to achieve a greater conversion of CO to $CO_2$ is to use augmented combustion air. However, as mentioned above, this undesirably decreases the efficiency of the heater.

Detailed investigations demonstrated a link between CO formation, the local flame temperature distribution, and the residence time of the heating gas in the combustion zone. It was observed that CO formation resulted from a cooling of flame partial products by incoming TEG prior to complete oxidation. A reduction of CO discharge was observed when the residence time of the heating gas (and therewith the CO) in the combustion zone behind (downstream of) the flame shield was increased and the mixing of TEG with the heating gas in the combustion zone was limited.

Residence time could be increased by enlarging the flame shield, but that increases TEG velocities and leads to undesirable turbulence. Thus, the inventors set out to find ways to increase the residence time for the heating gas while reducing the flow of excess TEG into the combustion zone and keeping turbulence low. Excellent results were obtained by forming a relatively long, narrow combustion zone which kept the mixing of TEG with the heating gas to the minimum level needed for the complete oxidation of the gas during its residence time in the combustion zone of the heater.

A flame shield configuration was developed which resulted in the formation of two successive recirculation patterns in the combustion zone. This provides for an increased residence time in a narrow flame corridor without excessive blockage of the TEG flow or undesirable flame patterns. While typical residence times for earlier flame shields were approximately 50 msec in the recirculation zone, the flame shield incorporated in the TEG heater of the present invention achieves residence times which are as much as three times longer. Additionally, by diverting the bulk of the TEG flow towards the end of the flame or combustion zone, where the oxidation of heating gas is effectively complete, CO emissions from the TEG heater are further reduced.

Thus, a TEG heater constructed in accordance with the invention provides a reduction in CO emissions of up to about 50% over those attained with earlier burners, including the one installed by the assignee of the present invention some years ago.

In addition, the present invention assists in minimizing $NO_x$ generation and emissions. $NO_x$ in TEG duct heaters can be reduced by reburning incoming $NO_x$ from the TEG by reverse reactions from $NO_x$ to $N_2$ in UHC-rich flames. Such reverse reaction rates are relatively slow and, therefore, the extent of $NO_x$ reductions from reburning is a function of the residence time of the $NO_x$ in the reburn zone. For TEG duct burners, the reburn zone is effectively the combustion zone behind (downstream of) the flame shield.

The present invention therefore also reduces $NO_x$ emissions.

A TEG heater constructed in accordance with the invention is installed in a duct, bounded by duct walls, through which the TEG flows in a downstream direction and includes a flame shield that extends along a line, e.g. the line formed by the horizontal center plane of the duct (for simplicity hereinafter usually referred to as "line" or "center line"), at least partially across the duct. The shield has a plate the ends of which are spaced apart from and are substantially parallel to the center line. The plate has a plurality of spaced-apart slits, arranged substantially parallel to the center line and respective edges of the plate. The edges are spaced apart from the proximate duct walls. A gas supply conduit is connected with the plate and extends along the center line at least partially across the duct. The pipe has a plurality of spaced-apart orifices which face in a downstream direction, are in flow communication with a downstream side of the plate, and arc arranged for discharging heating gas jets parallel to the downstream direction (and therefore also parallel to the center plane of the duct). Baffle plates extend from the respective duct walls towards the center line and end in baffle edges which are spaced apart from and parallel to the edges of the flame shield plates.

This TEG heater forms an elongated combustion zone which has two recirculation patterns, one behind the other downstream of the flame shield. The oxygen for combusting the heating gas is primarily obtained from TEG which flows through the relatively narrow slits in the shield. The gas jets from the gas supply pipe are parallel to the flow direction through the duct and avoid excessive turbulence immediately downstream of the flame shield while the gas is drawn into the recirculation eddies, thereby extending its residence time in the combustion chamber. Further, by constricting the main portion of the TEG flow between the opposing edges of the flame shield and the baffle just upstream of the combustion zone, gently converging TEG streams are formed which envelope the combustion zone without appreciably disturbing the recirculation patterns in the combustion zone. The TEG streams and the two flows combine at the end of the combustion zone where oxidation of the heating gas is substantially complete.

The end result, as indicated above, is that without augmenting air, CO emissions from the TEG heater are reduced by as much as 50% as compared to even the most recent prior art heaters of this type. Thus, a TEG heater constructed according to the present invention can have CO emissions as slow as 0.05 lb/$10^6$ btu, approximately half of what is allowable under today's stringent CO emission regulations. In addition, $NO_x$ emissions are lowered, yet the efficiency of the heater is high.

DESCRIPTION OF THE SPECIFIC EMBODIMENTS

Figure 1:
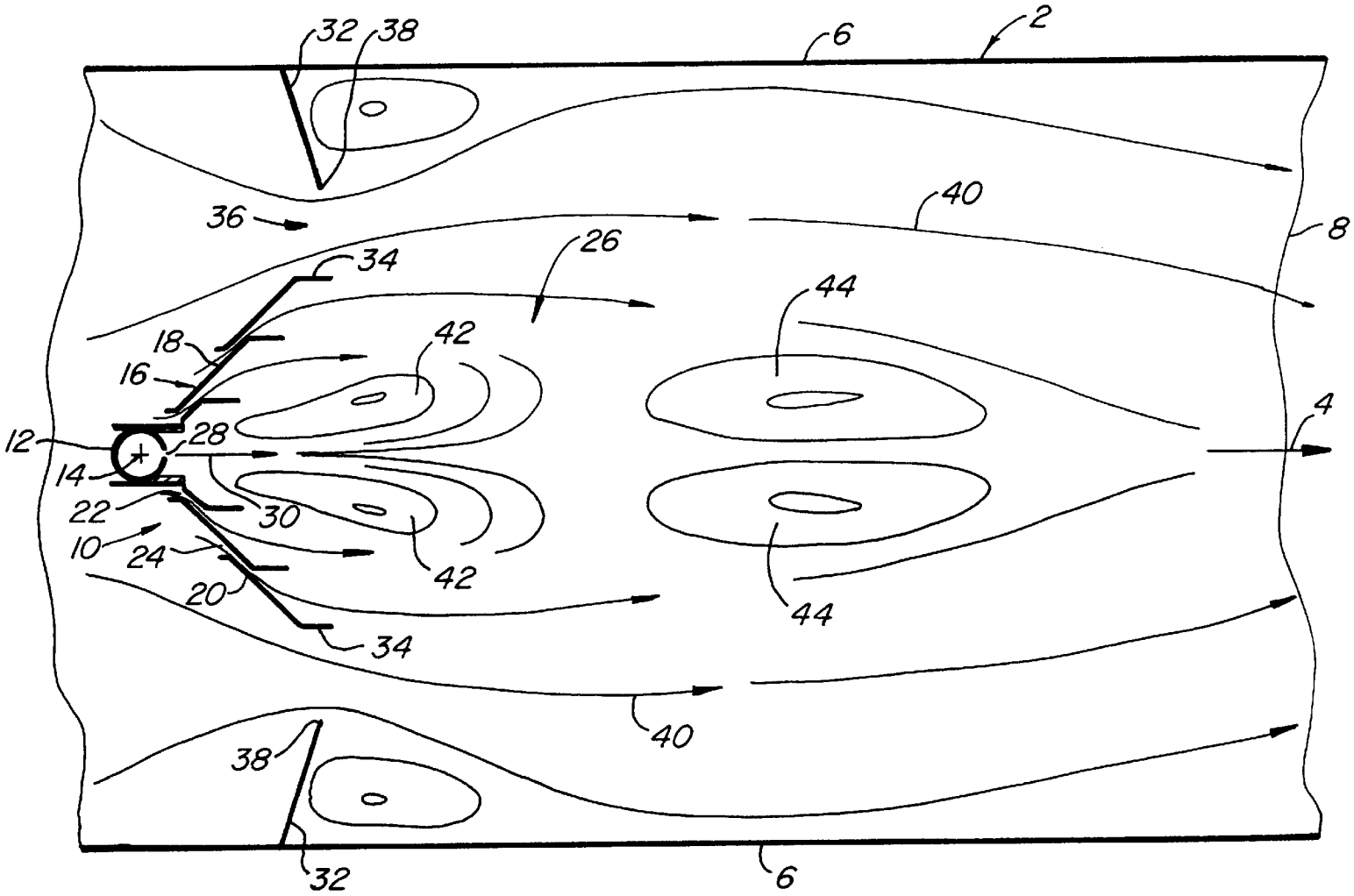
FIG. 1 is a schematic illustration of the flow and flame patterns formed by a turbine exhaust gas duct heater constructed in accordance with the invention.

Referring first to FIG. 1, a duct 2 through which TEG flows in a downstream direction 4 is formed by two sets of opposing duct walls 6, 6 and 8, 8. A duct heater 10 constructed in accordance with the invention has a normally horizontally disposed gas supply pipe 12 which extends across the width of the duct along its (horizontal) center line 14. The gas supply pipe includes a plurality of spaced-apart gas discharge orifices 28 which are arranged along the horizontal center line (plane) 14 of the pipe, face in the downstream direction, and discharge heating gas jets 30 parallel to the downstream direction into a combustion zone 26.

A flame shield 16 is defined by shielding plates 18, 20 which diverge from the gas pipe in a downstream direction towards duct walls 6, 6. Each plate includes first and second (horizontal) slits 22, 24 which permit a minor portion of the TEG to flow from an upstream side of the plates into a combustion zone 26 on the downstream side of the plates.

A baffle 32 extends from each duct side wall 6 into the duct and towards an end edge 34 of the proximate shielding plate and has a free baffle edge 38 that is parallel to and aligned with edge 34. This defines a constriction 36 between free baffle edge 38 and the opposing edge 34 of the shielding plate which has a width (perpendicular to the flow direction) that is a multiple of the width of slits 22, 24 in the flame shield plates.

In use, heating gas jets 30 from orifices 28 are injected into combustion zone 26 in (that is, parallel to) the downstream direction 4. TEG flows through the duct and initially impacts on the upstream side of flame shield 16. From there, most of the TEG flows through constrictions 36 and, downstream thereof, forms two flows 40 which envelope combustion zone 26 and combine again at the downstream end thereof.

Relatively small portions of the incoming TEG flow through slits 22, 24 in shielding plates 18, 20, from which they emerge on the downstream side of the flame shield. TEG passing through the inner slit 22 forms an inner flow much of which recirculates in a first or upstream recirculation zone 42 that is close to the downstream side of the flame shield. TEG passing through the outer slits 24 of the flame shield forms an outer flow which extends further downstream, is biased inwardly by the enveloping TEG flows 40, and forms a second, downstream recirculation zone 44.

The heating gas jets 30 initially enter the upstream recirculation zone where they are combusted with $O_2$ obtained from the inner TEG flow. The heating gas/TEG mixture then migrates towards the downstream recirculation zone. Additional $O_2$ from the outer TEG flow becomes available there so that the conversion of CO to $CO_2$ can continue. As a result, the combustion zone 26 is relatively long (and narrow), which increases the residence time for the CO so that more of it can be converted into $CO_2$ than is otherwise the case. By the time the now-combusted heating gas reaches the end of the combustion zone and reenters the main TEG flow, substantially all CO has been converted into $CO_2$ and $NO_x$ has been reburned as well, as is described above. Thus, downstream of the combustion zone, the now-heated TEG contains the above-mentioned low CO and $NO_x$ pollutant levels.

Downstream of the combustion zone, the heated TEG is used for steam generation or to otherwise extract heat energy from it, as is well known to those skilled in the art.

Figure 2:
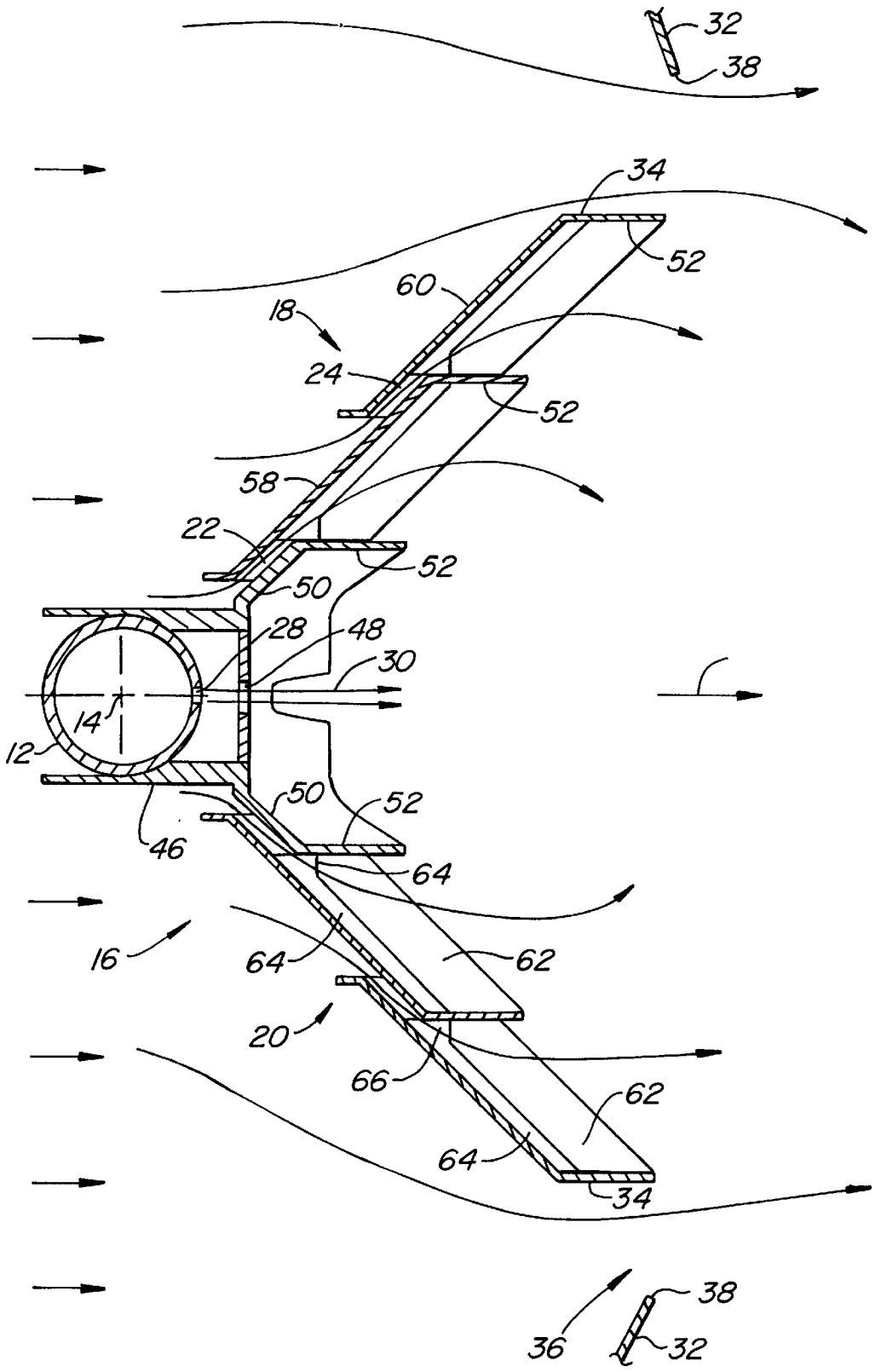
FIG. 2 is a fragmentary, side elevational view, in section, through the TEG burner of the present invention.
Figure 3:
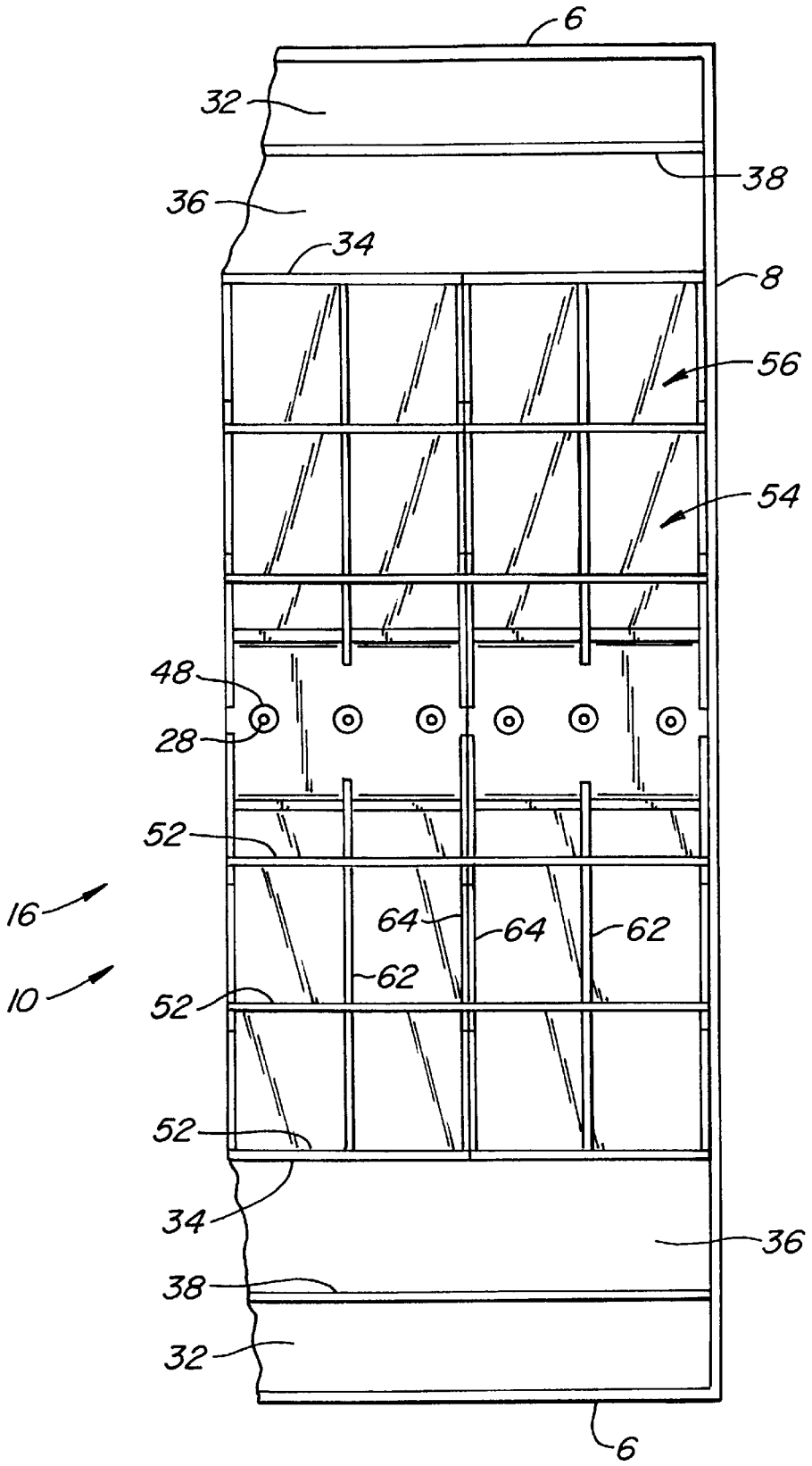
FIG. 3 is a partial, front elevational view of the burner shown in FIG. 2.

Referring now to FIGS. 2 and 3, in a practical embodiment of the invention, the flame shield 16 has a center piece the upstream end of which supports and is secured to gas pipe 12, e.g. with welds. The downstream side of the center piece includes enlarged openings 48, which are aligned with the heating gas orifices 28 in the pipe, so that gas jets can pass through the openings into combustion zone 26. The center piece has extensions 50 which diverge in a downstream direction and end in TEG flow stabilizing flanges 52. First and second extension wings 54, 56 are attached to each extension 50 and its stabilizing flange 52, preferably by welding, and are formed of elongated plate sections 58, 60. The plate sections are offset from each other in a downstream direction to form slits 22, 24 which are parallel to the plate sections and located between opposing, spaced-apart and overlapping surfaces of extension 50, plate section 58 and plate section 60, respectively. Each plate section also has a flow stabilizing flange 52. The outermost flange defines the earlier mentioned end edge 34 of flame shield 16.

In the preferred embodiment of the invention, the downstream side of each extension wing includes a center rib 62 which extends from the stabilizing flange of the wing section to the stabilizing flange of the next section, where it is attached, e.g. welded, to form a unitary structure defining shielding plates 18, 20. Preferably, each wing section includes at its lateral ends short ribs 64 which stabilize the associated plate section 58, 60 and which end in feet 66 which are also attached, e.g. welded, to the stabilizing flange of the adjoining extension wing.

In a preferred embodiment, the duct burner of the invention is fabricated from multiple, identical burner sections which are arranged side-by-side and abut each other, as is illustrated in FIG. 3. In this manner, duct burners for any desired duct width can be quickly and relatively inexpensively assembled.

What is claimed is:

1. A heater for heating a gaseous stream flowing in a downstream direction through a duct bounded by duct walls, the heater comprising a flame shield extending along a line at least partially across the duct and including a plate having end edges which are spaced from and substantially parallel to the line and a plurality of spaced-apart slits arranged between and substantially parallel to the line and respective end edges of the plate, the edges being spaced apart from proximate duct walls; a heating gas supply pipe connected with the plate and extending along the line at least partially across the duct, the pipe including a plurality of spaced-apart orifices for discharging heating gas jets substantially parallel to the downstream direction past the flame shield; and a baffle plate extending from respective duct walls towards the line and ending in baffle edges which are spaced apart from and aligned with the plate edges.

2. A heater according to claim 1 wherein the plate is obliquely inclined relative to the flow direction through the duct.

3. A heater according to claim 1 wherein the plate has two spaced-apart slits between the line and respective plate edges.

4. A heater according to claim 3 wherein the orifices are spaced apart from each other by approximately two inches.

5. A heater according to claim 1 wherein the spacing between the plate edges and the baffle edges is a multiple of a width of the slits in the plate measured in a direction perpendicular to the line.

6. A heater according to claim 1 including a flange associated with each slit and extending from the plate in a downstream direction, adjoining a slit, and being disposed on a side of the slit proximate the line.

7. A heater according to claim 1 wherein the baffle plates converge in the downstream direction towards the line.

8. A heater for heating turbine exhaust gas (TEG) comprising a duct formed by sets of opposing side walls and defining a center line across the duct between one set of opposing side walls, the TEG flowing in a downstream direction through the duct; first and second plates extending symmetrically with respect to the center line substantially across the duct, diverging in the downstream direction and terminating in plate edges which are spaced from proximate duct side walls, each plate defining spaced-apart, first and second slits which communicate an upstream side of the plate with a downstream side thereof, the slits being spaced from the center line and from the plate edges; a heating gas supply pipe extending parallel to the center line across the duct and having a plurality of spaced-apart orifices which face in a downstream direction and are in flow communication with the downstream side of the plate, all orifices being arranged for discharging heating gas jets substantially parallel to the downstream direction; and a baffle extending from the respective proximate duct walls towards the center line, terminating in baffle edges which are parallel to, spaced from and in substantial alignment with the plate edges; whereby heating gas injected into a space of the duct downstream of the flame shield ignites and first and second recirculation zones are formed which are spaced apart in the downstream direction to thereby extend a residence time of heating gas in the combustion zone sufficiently to substantially completely convert all CO in the combustion zone into $CO_2$.

9. A heater according to claim 8 wherein the baffle edges and the plate edges are aligned with each other.

10. A turbine exhaust gas heater according to claim 9 wherein the spacing between adjacent orifices in the heating gas pipe is no less than about two inches.

11. A turbine exhaust gas heater according to claim 10 wherein a spacing between opposing edges of the flame shield and the baffle is a multiple of a width of the slits, measured perpendicular to the center line.

12. A turbine exhaust gas heater according to claim 11 including a flange extending from a side of each slit proximate the center line from the plate in a downstream direction.

13. A turbine exhaust gas heater according to claim 12 including a further flange extending from respective plate edges in a downstream direction.

* * * * *